US011420080B2

(12) United States Patent
Lean

(10) Patent No.: US 11,420,080 B2
(45) Date of Patent: Aug. 23, 2022

(54) SECURE LIQUID CONSUMPTION FACE COVERING

(71) Applicant: Katherine M. Lean, Virginia, MN (US)

(72) Inventor: Katherine M. Lean, Virginia, MN (US)

( * ) Notice: Subject to any disclaimer, the term of this patent is extended or adjusted under 35 U.S.C. 154(b) by 0 days.

(21) Appl. No.: 17/317,373

(22) Filed: May 11, 2021

(65) Prior Publication Data

US 2021/0353979 A1 Nov. 18, 2021

Related U.S. Application Data

(60) Provisional application No. 63/101,737, filed on May 12, 2020.

(51) Int. Cl.

| | |
|---|---|
| ***A62B 18/08*** | (2006.01) |
| ***A62B 18/02*** | (2006.01) |
| ***A62B 23/02*** | (2006.01) |

(52) U.S. Cl.

CPC ..... *A62B 18/086* (2013.01); *A62B 18/025* (2013.01); *A62B 23/025* (2013.01)

(58) Field of Classification Search

CPC ..... A62B 18/086; A62B 23/025

See application file for complete search history.

(56) References Cited

U.S. PATENT DOCUMENTS

| | | | | |
|---|---|---|---|---|
| 183,521 | A * | 10/1876 | Weck | B63C 11/26 128/202.15 |
| 1,366,437 | A * | 1/1921 | Wagenhorst | A62B 18/086 128/202.15 |
| 2,023,267 | A | 12/1935 | DE Saint Rapt et al. | |
| 3,298,031 | A * | 1/1967 | Harold | A41D 13/1184 2/9 |
| 4,536,440 | A | 8/1985 | Berg | |
| 4,712,594 | A * | 12/1987 | Schneider | A62B 18/086 128/206.22 |
| 4,890,609 | A * | 1/1990 | Wilson, II | A61M 16/06 128/206.29 |
| 5,155,863 | A * | 10/1992 | Roberts | A61F 9/029 128/202.13 |
| 6,257,235 | B1 * | 7/2001 | Bowen | A62B 23/025 128/206.12 |
| 6,543,450 | B1 | 4/2003 | Flynn | |
| 6,718,971 | B2 * | 4/2004 | Horn | A62B 18/086 128/201.26 |
| 6,932,239 | B2 | 8/2005 | McKitrick | |
| 7,044,127 | B1 | 5/2006 | Fernandez DeCastro | |
| 7,073,688 | B2 | 7/2006 | Choi et al. | |

(Continued)

FOREIGN PATENT DOCUMENTS

| | | | | |
|---|---|---|---|---|
| DE | 10012701 | B4 | 7/2004 | |
| GB | 2426711 | A * | 12/2006 | A62B 18/086 |

*Primary Examiner* — Bradley H Philips

(74) *Attorney, Agent, or Firm* — Schwegman Lundberg & Woessner, P.A.

(57) ABSTRACT

A secure liquid consumption face covering is created for the general public that is flexible so that the user does not need to remove or open a mask when thirsty or hungry to consume liquid. Through a tube attached with connector(s) and lock(s) to the mask and with an optional disposable straw unit, the wearer can drink liquid from any vessel easily without taking the mask off or breaking the seal of the mask around the user's nose and mouth.

10 Claims, 10 Drawing Sheets

(56) References Cited

U.S. PATENT DOCUMENTS 7,810,493 B2 * 10/2010 Resnick ..... A45F 3/16 128/202.15
7,958,889 B1 6/2011 DeCastro
8,342,577 B2 1/2013 Schoenoff et al.
10,421,655 B1 * 9/2019 Steele ..... A45F 3/16
10,502,351 B2 12/2019 Jaeger et al.
10,905,905 B1 * 2/2021 Dettore ..... A62B 23/025
10,980,296 B1 * 4/2021 Hosac ..... A62B 18/10
11,117,000 B1 * 9/2021 Mortimer ..... A62B 9/04
2004/0155054 A1 * 8/2004 McKitrick ..... A62B 18/086 222/1
2004/0237962 A1 * 12/2004 Russell ..... G02C 11/00 128/201.17
2005/0051235 A1 * 3/2005 Kline ..... A62B 18/086 141/351
2005/0126566 A1 * 6/2005 Stone ..... A62B 18/086 128/202.15
2006/0231561 A1 * 10/2006 Choi ..... A45F 3/20 220/714
2007/0283964 A1 * 12/2007 Gorman ..... A62B 23/025 128/206.29
2009/0036874 A1 * 2/2009 Horowitz ..... A61M 25/0017 604/544
2009/0045205 A1 * 2/2009 Wild ..... A62B 18/086 220/703
2009/0151734 A1 * 6/2009 Park ..... A61K 33/24 128/863
2010/0224199 A1 * 9/2010 Smith ..... A61M 16/142 128/863
2012/0103327 A1 * 5/2012 Low ..... A62B 18/086 128/202.15
2012/0247474 A1 * 10/2012 Torbenson ..... A62B 18/086 128/206.15
2015/0290478 A1 * 10/2015 Curran ..... A62B 18/10 128/201.25
2016/0129287 A1 * 5/2016 Danford ..... A62B 23/025 128/863
2016/0228328 A1 * 8/2016 Wengreen ..... F25D 3/08
2017/0028229 A1 * 2/2017 Gray ..... A62B 18/086
2017/0095015 A1 * 4/2017 O'Leary ..... A41D 13/1184
2018/0035787 A1 * 2/2018 Jaeger ..... A47G 21/185
2018/0256926 A1 * 9/2018 Kyung ..... A62B 18/088
2018/0280738 A1 * 10/2018 Gabriel ..... A62B 18/025
2018/0280758 A1 * 10/2018 Tao ..... A63B 21/00058
2019/0062039 A1 * 2/2019 Ito ..... A62B 18/082
2020/0100552 A1 * 4/2020 Jaeger ..... A42B 3/048
2020/0114179 A1 * 4/2020 Torbenson ..... A41D 13/1138
2020/0405023 A1 * 12/2020 Cook ..... A61F 9/04
2021/0086005 A1 * 3/2021 O'Brien ..... A61P 19/00
2021/0093899 A1 * 4/2021 Huang ..... B01D 39/083
2021/0187147 A1 * 6/2021 O'Toole, III ..... A61L 9/12

* cited by examiner

SECURE LIQUID CONSUMPTION FACE COVERING

CROSS-REFERENCE TO RELATED APPLICATION

This application claims the benefit of U.S. Provisional Application No. 63/101,737, entitled "Secure liquid consumption face covering", filed May 12, 2020, the disclosure of which is incorporated herein by reference in its entirety.

TECHNICAL FIELD

The present disclosure broadly related to face masks used for drinking purposes.

BACKGROUND

During the past fifty years or so significant advancements have been made in the development of filtering face-piece respirators and other disposable filter respirators for use in construction, mining, painting and in the medical professions. In addition, dust masks, surgical masks, filtering face-piece respirators, etc. provide the wearer a certain assurance that various sizes of airborne particles may be filtered so as not to contaminate their lungs up to an N95 NIOSH (The National Institute for Occupational Safety) Approval. Various adaptations have occurred in the design of such masks, their size and shape. We have witnessed the addition of a shielding added layer of protection on such masks for medical professionals against blood and other liquids and the appearance of several comfort features including an exhalation valve which provides for a cooling effect, padded nose clip, and various placements and different types of straps. Disposable filters and designs of other masks and respirators where the mask body is integrally, in fact, the filter itself have continually advanced with the creation and advancement of non-woven technology. Respirators for the trades to filter out chemical smells and other harmful pollutants and airborne particles up to an N99 NIOSH Approval have also evolved. In military settings we have seen several advancements in the realm of gas masks used for needs at an N100 NIOSH Approval including those with an attached flask.

And while there have been various outbreaks of viral infections in Asia and Africa over the past twenty years or so, masks have not been required to be worn by the general public across continents during the same period. That is, until now in certain circumstances with the COVID-19 pandemic. Therefore, we, as such, have seen little or no patents that address special needs that the general public has when they must keep a mask on for extended periods of time. Rather, guidance from governmental organizations during 2020 and thus far in 2021 is to take the mask off in order to eat or drink in crowded situations or while social distancing at approximately 6 ft, rather than keeping the mask on. And this guidance, it is understood, may have been made because there is no such alternative on the market to allow the mask user to consume liquids while wearing their mask.

One such need that arises when an individual is required to wear a mask for an extended period of time is the ability to safely hydrate oneself every couple hours without removing the mask and without breaking the seal. In the past, the trades and those in medicine have had the luxury of leaving their contaminated or sterile work environment to take a break. While resting or eating in a break room, they could remove their mask, dispose of it, and take a new one when going back to work. In only a couple instances has a need to drink with a mask on been addressed in the past. Bicycle riders who travel great distances have available to them a face mask that possesses an exhalation valve that may be used as a resistance valve, and a hydration bag in a special backpack device that allows them to drink while cycling. The military can drink straight from a flask connected to their gas mask.

But as the Covid-19 pandemic continues, governments and various jurisdictions, agencies, and businesses require individuals to wear masks, and as guidance from the CDC, the FAA, etc., changes, it is impractical for the general public to purchase and wear a gas mask or a bicycle riding mask and hydration unit with backpack just to drink a hot coffee, have a smoothie, or a bottle of juice or water. Furthermore, airlines are requiring both passengers and crew alike to wear masks at all times when flying. The FAA has required passengers wear masks of certain types at check-in, security checks and while going through baggage claim. Yet, in all instances, individuals are recommend in guidance to take the mask off to drink or eat, thus exposing themselves to airborne particles that may contain the corona virus or a mutant strain.

This requirement to both wear a mask in an enclosed environment and for extended periods of time is potentially dangerous, as is taking it off in that same environment to hydrate oneself or eat. The human body is in need of liquid every several hours. In its absence, the individual will become dehydrated. On a commercial flight of 5-6 hours, it is conceivable that with today's rules in place at airports and while flying, a passenger may have a mask on for a minimum of 8-8.5 hours if flying across the entire United States and if internationally that time can increase two-fold. If one or more transfer is necessary, that length of time will also increase. Therefore, it is imperative to be able to drink safely from any type of vessel without removing one's mask and breaking its protective seal. In addition, both nurses and doctors, and EMS who are treating or possibly treating COVID-19 positive individuals and are unable to remove all of their PPE equipment every 2-3 hours during the day for breaks and lunch suffer greatly on a daily basis for extended shift periods.

Over the course of the past few years prior to the Covid-19 pandemic one such invention that attempted to address the need to access fluids in a mask setting tried to solve the problem by placing a screw top over a cut out hole in the center of the mask into which a regular straw could be placed. Unfortunately, when the top covering over the mask hole is opened it exposes the wearer of the mask to the air and breaks the seal of the mask. A similar situation occurs with a recently developed mask that has a zipper on it through which a straw may be used, or one may drink liquid directly from a cup, glass or bottle. Other photos of individuals on the internet who have cut holes in masks to stick a straw through it are present as is one with a small push on plug for the hole. None of these methods solves the issue to securely be able to hydrate oneself without breaking the tight seal of the mask covering the user's nose and mouth.

Therefore, this patent creates a secure liquid consumption face covering for the general public. It is flexible so that the user does not need to remove or open the face covering when thirsty or hungry to consume liquids. Rather, through tubes with connector(s) and lock(s) and an optional disposable straw unit, they may drink from any vessel easily without breaking the snug seal of the mask around the user's nose and mouth. Furthermore, it has the potential to change the dynamic of the beverage industry on airlines. Regular beverages could again be served onboard rather than just a bottle of water, and an extended line of warm soups, smoothies and protein drinks could be added and made available to compensate for solid meals.

SUMMARY OF THE DISCLOSURE

The present disclosure is directed to a secure liquid consumption face covering for the general public capable of being worn for extended periods of time in conditions where one needs to hydrate oneself without taking off said face covering. Said face covering may include a mask body, inner mouth piece, tubes, secure couplings, and an optional disposable unit. The mask body fits snuggly over the users nose and mouth and is adapted in such a way for a secure liquid consumption apparatus to be affixed to it so that drink fluid may be drawn up to the user's mouth. In some embodiments the face covering is a scarf, balaclava, neck gaiter, bandana, snood, homemade mask, mask, dust mask, surgical mask, filtering face respirator, or medical filtering face respirator, etc. either itself made of filtered material or with a filter insert, capable of filtering up to about 95% of airborne particles to about 0.3 microns, but not filtering above a NIOSH N95 Approved standard or equivalent as the N99 and N100 NIOSH Approval standards or equivalent for respirators and for gas masks make it simply too difficult for the general public to comfortably breath through them for long periods of time. In other embodiments said face covering may be made of non-wovens. Yet in another embodiment the material may be of such a nature that it contains anti-microbial, anti-bacterial, or anti-virus properties having the ability to kill such pathogens, deflect them or absorb them up to about 99.97%.

In some embodiments, the secure liquid consumption apparatus may be made of readily available parts including a double barbed flange to which a connector and shut off mechanism are connected. An external tube flexible in nature may be further connected to said apparatus and benefits at one end from a secure connection mechanism able to connect to a disposable straw unit by connectors, coupling or by a luer or a quick release coupling unit of gendered fitting that will be used to draw the liquid up to the user. The disposable straw unit may be encased in packaging in a sterile medium prior to use and after use and consists of a secure connection device that may be lockable, an additional external tube, and an open end that provides access to the drink fluid. In some embodiments, on the external tube, one or a plurality of clamps encircles the tube and the external tube engages the drink fluid directly at the other open end.

In other embodiments, the mask body itself is of a molded filtered mask type which may be covered by other whereby the filtered mask itself is the filter or is used as the filter insert. Yet, in other embodiments, the face covering consists of a mask body is flexible with no filtration device, or yet in other embodiments it is made of material or a'plurality of materials such as natural or man-made, woven or non-woven material presented in layers whereby a pouch/pocket is created and into which one or a plurality of layers of dye-cut filtration materials with no less than one hole cut is sandwiched into the pouch and may be replaceable.

The secure liquid consumption face covering according to the present disclosure may further include a quick disconnect fitting in the shape of a female coupler on one end of the external tube that fits securely together with a reusable male quick disconnect coupler fitted on the additional external tube. Once the couplers have joined the tubes together by pushing the two pieces together, by twisting together the two pieces, or in more advanced versions pushing the pieces together until an audible click sound is heard to signal it is locked, one can release a clamp or cock-stop nearest the mask to begin drinking. The additional external tube may be enclosed in a sanitary pouch (a sterile covering) prior to connection of the gendered coupling devices and prior to engagement with a liquid. When drinking, such a protective covering in the form of a sanitary pouch may be pushed up around the male connector which may be reusable and that contains attached to it on one end the additional external tube may be slipped up over the shaft of the additional external tube and connectors when the far end is placed into the liquid. Furthermore, said sanitary pouch may contain both the female and male couplers between uses.

In another embodiment, the secure liquid consumption apparatus consisting of at least a flange with opposable barbs which may be secured to part of a clear covering mounted in the mask body over the mouth area. This allows the mouth of the wearer to be seen for those who lip read or who are hearing impaired. In another embodiment, a secure liquid consumption tubular device may be created in one continuous flexible piece and disposed through the hole in the mask body to the interior mask body at one end, whereby the other end is open and capable of being placed in a liquid, or in another embodiment, is capable of fitting to a quick disconnect coupler which can fit to a disposable straw unit. One or a plurality of clamps or stop-cocks may be placed along the external tube of said members in order to stop either air or liquid from flowing through the device.

Many adaptations can occur with the secure liquid consumption face covering have a punch type end on the units open ends nearest a container that contains liquid. Or, goggles with or without technical modifications attached such as communications devices being present in any embodiment or ear protectors available to cover the ear canal for various reasons.

Many other features of the present disclosure will become manifest to those versed in the art upon making reference to the detailed description which follows and the accompanying drawings in which preferred embodiments incorporating the principles of this disclosure are disclosed as illustrative examples only. Any dimensions to the drawings are shown for purposes of illustration, but dimensions other than those shown may be used and are within the scope of the present disclosure.

The resulting secure liquid consumption face covering may remain on for situations when the wearer is unable and unwilling to remove any mask body from its secure position over the nose and mouth in order to drink a liquid. The advantage of any embodiment of a secure liquid consumption face covering is found in the built-in secure liquid consumption tubular device and the disposable straw unit comprises of the flexible tubes through which the wearer may securely drink liquid from any vessel. This can easily be worn during the COVID-19 pandemic on an airplane, train, bus, metro, at work, in a hospital setting or anywhere proper social distancing norms are unable to be fully met, or anytime an individual ventures out of the home for extended periods of time where a mask must be worn.

LIST OF PARTS

100 secure liquid consumption face covering
200 mask body
210 mask body interior

220 mask body exterior
225 hole on mask body
230 removable filter
231 interior side of removable filter
232 exterior side of removable filter
235 pouch for removable filter
240 side opening for removable filter
245 hole(s) in removable filter
246 flap on removable filter
250 secure nose adjustor unit
255 interior nose unit
270 harness
300 secure liquid consumption apparatus
301 secure liquid consumption tubular device
302 secure liquid consumption tubular extension device
305 flange
310 internal barb of flange
315 mouth piece
316 mouth piece attachment
320 mounting base/flange
321 front side of mounting base
322 back side of mounting base
330 external barb of flange
400 external tube
401 shaft of the external tube
410 stop-cock
412 clamp
413 attachment unit
415 female connector
416 male connector
420 female quick disconnect fitting/coupler
425 male quick disconnect fitting/coupler
430 lock release on female quick disconnect fitting/coupler
450 liquid engaging open end of external tube
500 disposable straw unit
510 additional external tube
520 shaft of the additional external tube
530 liquid engaging open end of additional external tube
600 sanitary pouch
610 body of the pouch
620 drawstring ends of pouch
700 attachment clip
710 unit fixture
720 attachment modifier
740 communication device
750 exhalation valve
760 goggles
765 goggle attachment landing space
780 ear canal coverings
785 ear canal clips

DESCRIPTION OF THE PREFERRED EMBODIMENTS

Figure 1:
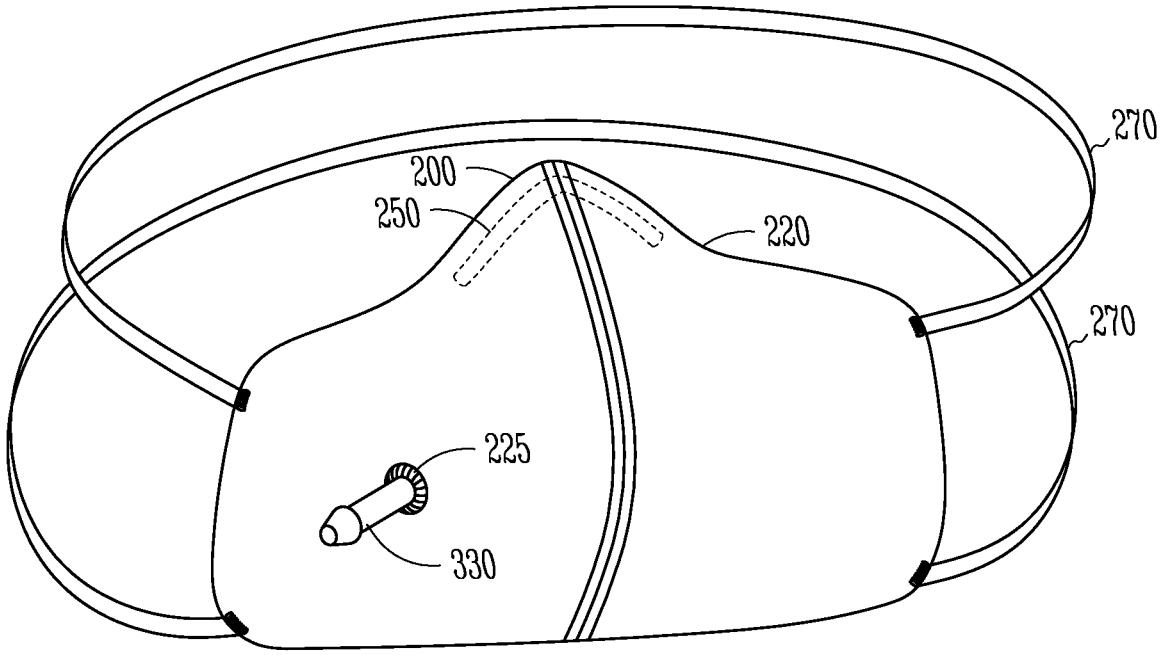
FIG. 1 is a frontal view of the exterior of a homemade mask body with hole and harness

In practicing the present invention, a new secure liquid consumption face covering is provided that may give the wearer of said face covering the ability to drink food or beverage from any available vessel without breaking the seal of a face covering around the wearers nose and mouth or having to take it off. This present invention thus may improve lives of passengers and crew on airlines and those involved in other long haul travel by bus or train, those in the medical profession, and laborers who regularly wear personal respiratory protection devices or other face coverings for an extended period of time in conditions that do not permit the removal of the face covering.

The secure liquid consumption face covering 100 comprises in one embodiment a mask body 200 which may fit snugly over the nose and mouth with the aid of a secure nose adjustor unit 250 and may be any scarf, balaclava, neck gaiter, bandana, snood, homemade mask, mask, dust mask, surgical mask, filtering face respirator, or medical filtering face respirator, etc. either itself made of filtered material or with a removable filter 230 modified as needed to fit around a hole on the mask body 225 and further comprising a secure liquid consumption apparatus 300 modified as needed in various embodiments some of which are described below and may comprise of a secure liquid consumption tubular device 301 with harness 270, external tube 400, an additional external tube 510 and connectors 415, 416, and couplers 420, 425 and a disposable straw unit 500 or may be streamlined into one member whereby the continuous one unit version acts independently and may become in this embodiment a secure liquid consumption tubular extension device 302, a sanitary pouch 600 and an attachment clip 700.

In addition, various embodiments may include an exhalation valve 750 secured to the mask body 200, a communication device 740, goggles 760 that may attach to or be an integral part of the mask body 200 or the harness 270 and ear canal coverings 780.

FIG. 1 The mask body 200 has a mask body interior 210 and a mask body exterior 220. Said mask body 200 may be made of one or a plurality of layers of any suitable materials either natural or manmade materials including high thread-count tight weaves or looser weaves including, for example, cotton, wool, rayon, polyester, blends, synthetics, synthetic blends, plastics, of filter material including, for example, a melt blown layer or plurality of layers, an electrostatic layer or plurality of layers, silk, chiffon, etc. In addition, mask body 200 may have a layer of non-permeable non-woven or woven or treated material that is able to repel blood or liquids from the inner gaseous area of the mask nearest the wearer, or may be made of an anti-microbial layer that kills, repels, or absorbs up to 99.97% of such microorganisms, bacteria or viruses.

Mask body 200 with the aid of a secure nose adjustor unit 250 which may be disposed at the top of the nose bridge area of said mask body 200 on the mask body exterior 220 or the mask body interior 210, or sandwiched between layers of said mask body 200 or the pouch for removable filter 235 and may be made any suitable shape and of any suitable material such as but not limited to metal, hardened plastics, pipe cleaner, encased wire, sponge, etc. and may form a secure airtight seal over the nose of the wearer.

The interior nose unit 255 may be disposed and attached on the mask body interior 210 or sandwiched between the layers of either the mask body 200 or filtration medium used, and may be made of any suitable material such that said interior nose unit 255 may provide a cushioned surface for the wearer or may contain adhesives capable of hugging and comforting the nose area so that eye glasses or other eyewear can rest easily upon the upper mask body exterior 220, a soft bond may be created between the wearer's skin and the material of said interior nose unit 255, or it may contain such an attachment modifier 720 and the mask body 200 be of any such configuration so as to provide a goggle attachment landing space 765 for goggles 760 that the wearer optionally may wear together with the mask.

Mask body 200 may have a harness 270 made of one or a plurality of secure straps, tie strings, or any other suitable material attached to it for supporting said mask body 200 on the wearer's face or may be an integral part of said mask body 200 itself integrally formed of the same material as mask body, for example, elastic or other weaves placed on the bias, or cords that may be tied, or straps or cords that may be knotted to lessen the size of the secure straps, or non-wovens, wovens, natural or synthetic materials, etc. in order that said mask body 200 provides a secure fit over the nose and mouth of the wearer. In addition, in other embodiments, an exhalation valve 750 may be deployed on mask body 200 by hot gas welds, sonic welds, adhesive bonding, mechanical clamping, and the like, or the harness 270 of the mask body 200 may be integrated in part or in whole with or without the use of a unit fixture 710 made of any suitable material and placed in such a way as to be an integral member integrated into the goggles 760, or into which a communication device 740, ear canal coverings 780, or ear canal clips 785 etc. may be disposed.

Figure 2A:
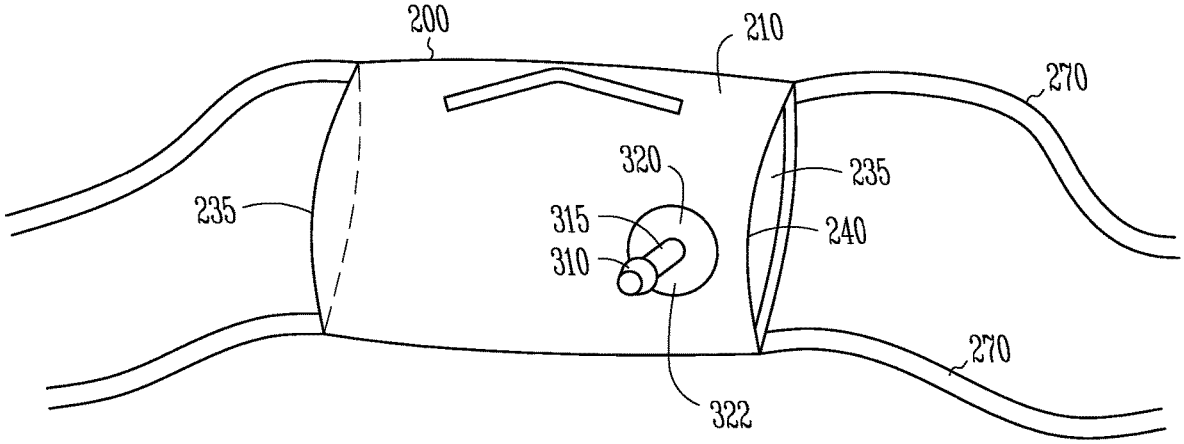
FIG. 2A is a back view of the interior side of a homemade mask body with frontal view of the replacement filter to be inserted into the pouch for removable filter

FIG. 2A In the absence of the mask body being made of filter material, itself comprising a shaping providing structure and support for a shaping layer and filter layer, a pouch for removable filter 235 into which may be disposed a removable filter 230 which may be reusable or disposable through a side opening for removable filter 240 may be disposed between layers of the mask body 200, or on said and accessible from the mask body interior 210. A removable filter 230 has an upper and a lower face and may comprise one or a plurality of layers of filter material used for filtration preferably up to about 95% of airborne particles to an N95 NIOSH Approval. The materials, for example, may include melt blown material, static material, or other suitable material. The slit may be covered on the exterior side of removable filter 232 or the internal side of removable filter 231 with a flap on removable filter 246 made of similar material as the filter medium used.

Figure 2B:
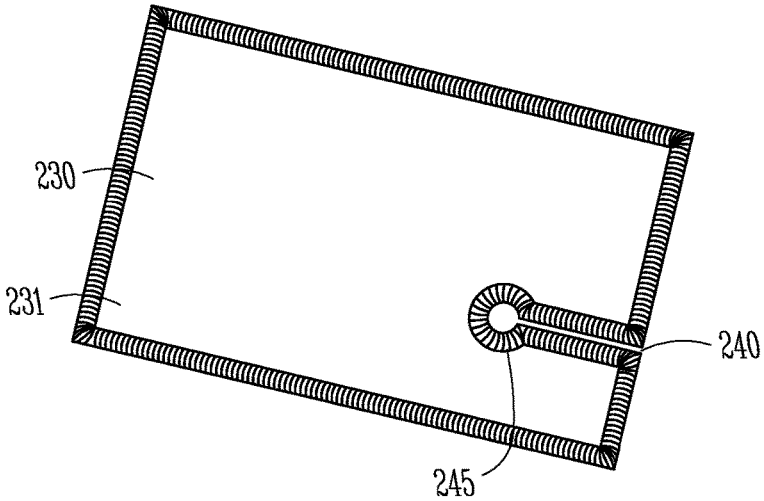
FIG. 2B is a back view of a removable filter
Figure 2C:
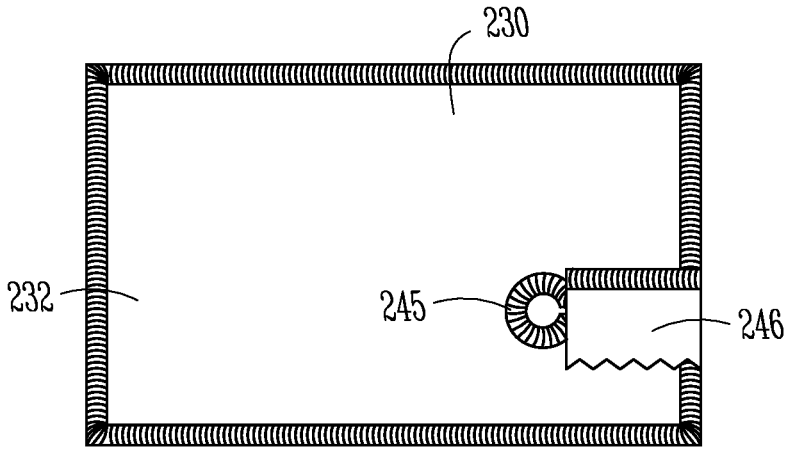
FIG. 2C is a face view of a removable filter

FIG. 2B and FIG. 2C The form of the removable filter 230 is such that it may have a slit and one or a plurality of holes in the removable filter 245 so that it may slide into the pouch for removable filter 235 in order to accommodate the hole on the mask body 225 through which the secure liquid consumption tubular device 301 is disposed creating a flap on removable filter 246 due to the removable filter being cut as such to compensate for the slit necessary so as to provide a covered layer of filtering by the removable filter 230. Additional holes in both the mask body 200 and the removable filter may be necessary due to the needs of additional members such as an exhalation valve 750 being added to the secure liquid consumption face covering.

Figure 3A:
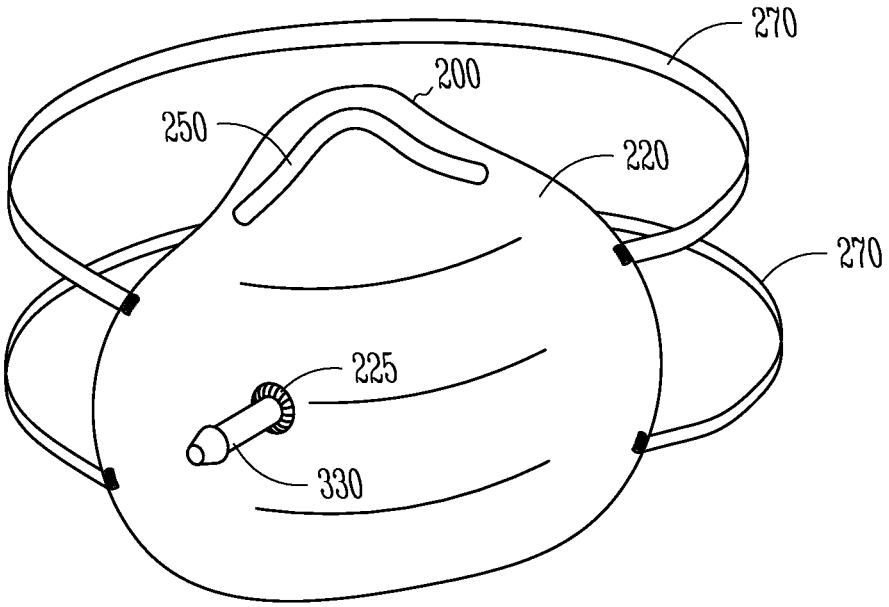
FIG. 3A is a frontal view of an external side of a mask body of a molded filtering face respirator of a secure liquid consumption face covering highlighting the external barb of flange

FIG. 3A If the mask body 200 in and of itself is integrally considered as the filtration layer it may be made up of, for example, a nonwoven layer of thermally bondable fibers molded into a cup shaped configuration or of a porous layer or open work fishnet or flexible plastic. A shaping layer provides shape and structure and may act as a filter to capture large particles.

Where the mask body 200 either itself is made of filtered material and is integrally formed or possesses a filter insert area and made of other materials creating shape, for the general public to use such a secure liquid consumption face covering 100 said may filter up to about 95% of airborne particles or a NIOSH N95 Approved standard or equivalent. Yet in another embodiment the material may be of such a nature that it contains anti-microbial, anti-bacterial, or anti-virus properties or materials such as silver or copper or other such metals possessing such medicinal properties and having the ability to kill such pathogens, deflect harmful micro-organisms or absorb them up to about 99.97%.

Alternatively, if a removable filter 230 and a pouch for removable filter 235 are absent from the mask body, the materials from which the mask body 200 is made may either have few filtration capabilities other than those naturally provided by the given material from which it is comprised, or when it possesses very high filtration capabilities, in this instance a mask body 200 that is molded may also be used as a removable filter 230 whereby it may be sandwiched between other woven or nonwoven sewn materials that form a mask body interior 210 and a mask body exterior 220, for example using an N95 facial filtered respirator as the removable filter 230 rather than as the mask body 200 provided there is a hole in removable filter 245 in order to allow the exterior barb of flange 330 to go through it. The interior side of removable filter 231 may have a side opening for removable filter 240 and a flap on removable filter 246 in order to secure the mask. In addition, a mask body 200 can be made of an anti-microbial, anti-bacterial, anti-viral material or materials that may have silver or copper or other metals known to repel or kill micro-organisms, the filtration properties will instead be those of repelling or killing.

The flange 305 comprising of mounting base 320 with a front side mounting base 321 and a back side mounting base 322 comprising of a hollow middle core that extends through said mounting base 320 to an external barb of flange 330 comprising of a hollow middle core and disposed on said front side mounting base 321 of said mounting base 320 at about a 90 degree angle to said front side mounting base 321 and extends through a hole on mask body 225 and may extend through a hole on removable filter 245 leaving said front side mounting base 321 of said mounting base 320 resting against, disposed or secured onto said mask body interior 210 or sandwiched, disposed, or secured between the mask body 200 and removable filter 230.

Figure 3B:
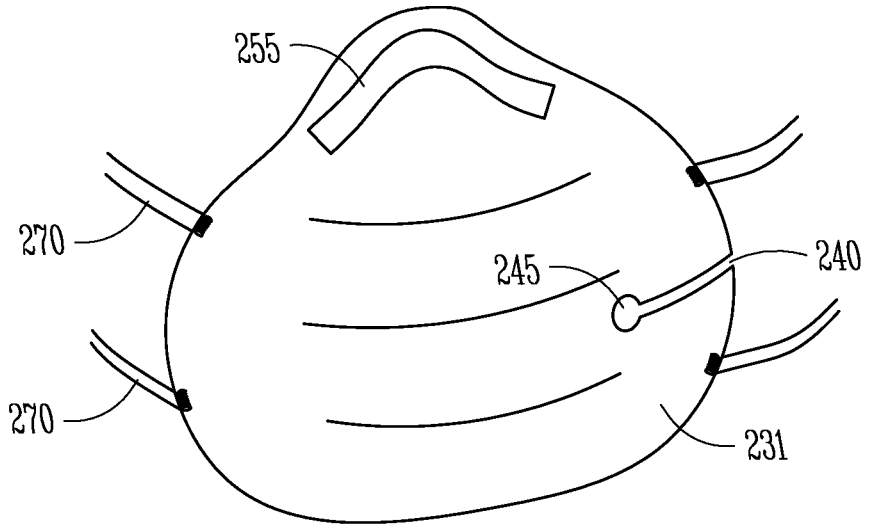
FIG. 3B is a frontal view of the external side of a mask body of a molded filtering face respirator modified and used instead as a replacement filter of a secure liquid consumption face covering highlighting the side slit and hole
Figure 3C:
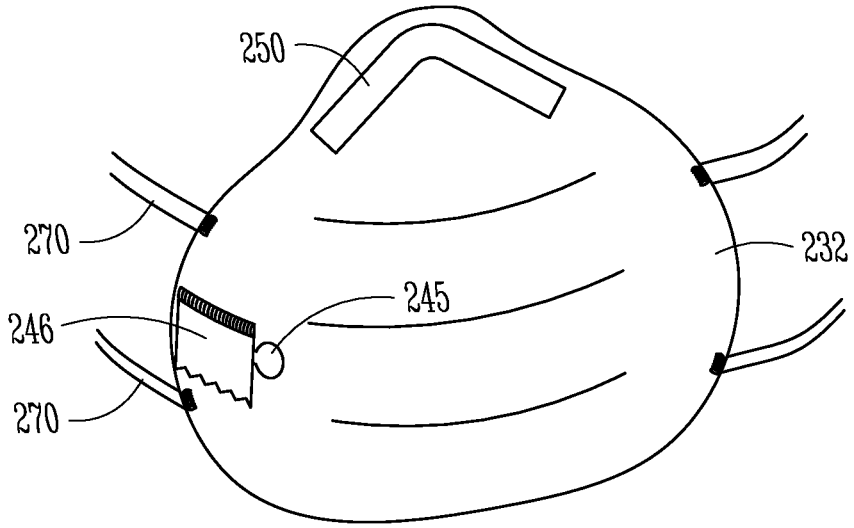
FIG. 3C is a view of the internal side of a mask body of a molded filtering face respirator modified and used as a replacement filter of a secure liquid consumption face covering highlighting the flap and hole

FIG. 3B The flange 305 is situated in such a way in order to allow back side of mounting base 322 of the mounting base 320 for the internal barb of flange 310 to protrude into the mask body interior 210 and the external barb of flange 330 to protrude from the mask body exterior 220 and is an integral part of the secure liquid consumption apparatus 300. Furthermore, said internal barb of flange 310 may form a mouth piece 315 in and of itself. Or, a mouth piece attachment 316 can be placed on an internal barb of flange 310 such as a cap, nib, drinking member that may form a pull/push stop, an oscillating pull out piece, a nipple or other formed piece, or piece of tubing or a custom part designed to be molded or extruded for use by the mouth in order to suck up liquid through the secure liquid consumption tubular device 301 that is attached to external barb of flange 310. Alternatively, an integral streamlined one piece unit without separation may be created that consists of the flange 305 portion with an internal barb of flange 310 and an external tube 400.

The flange 305 and its barbs 310, 330 may be made of any suitable material including, for example, metal, wood or wood composites, and/or plastic (e.g., low density polyethylene, polypropylene, polyvinylidene fluoride or polyvinylidene difluoride (PVDF), polyvinyl chloride (PVC), and non-PVCs, anti-microbial coated plastics and thermoplastics). Regardless of the material selected, it should desirably be fabricated into sufficiently sturdy but flexible to function without breaking during normal use. The mounting base 320 is disposed to the mask body 200 or interior facing side opening for removable filter 240 of the pouch for removable filter 235 by hot gas welds, sonic welds, adhesive bonding, mechanical clamping, sewing, etc.

The flange 305 of any suitable shape may be disposed to the mask body interior 210 by either heat treatment, sewing or a snapped on mechanism by puncturing the material through a hole in the mask body 200. The flange 305 may also be positioned such that it is disposed in a similar fashion to material layers of the mask body 200 or sandwiched between said layers of or on either side of the mask body 200 or between layers of one or a plurality of layers of material that forms the pouch for removable filter 235 depending upon whether or not the mask is disposable or not. The flange may also be positioned to the underside of the mask body exterior 220 or the outer side of the mask body exterior 220.

Figure 4:
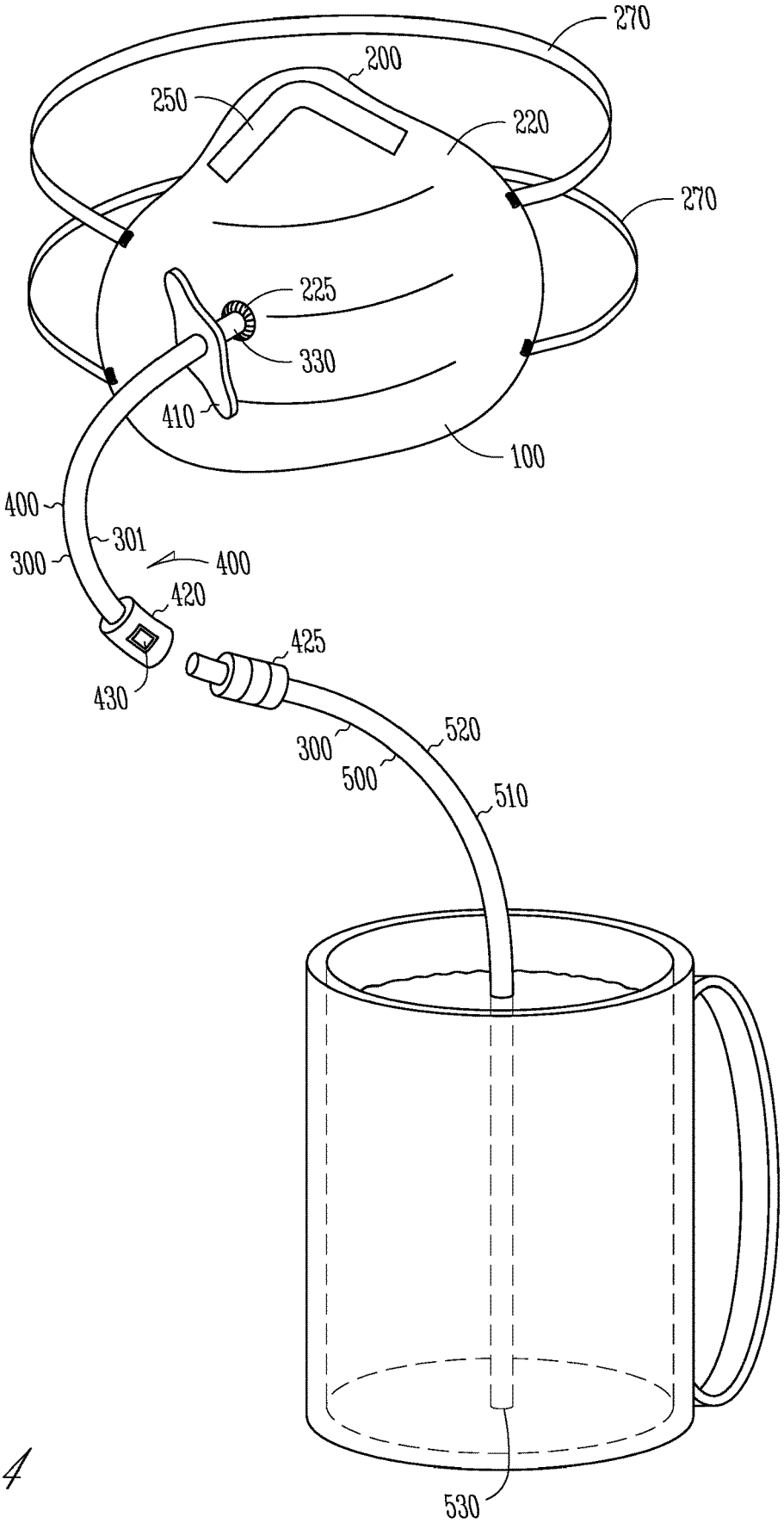
FIG. 4 is a view of the secure liquid consumption apparatus about to be engaged in order to drink coffee from a cup

FIG. 4 In one embodiment the external barb of flange 330 may connect to the secure liquid consumption tubular device 301 on one end by pushing or twisting one end of a flexible external tube 400 onto an external barb of flange 330 which may be threaded, smooth, etc. A clamp 412 or plurality of clamps of any suitable size or shape such as a simple clamp, a roller clamp, slide clamp, etc. attached to the external tube 400 with or without the aid of a female connector 415 or a male connector 416 on another end may be used to shut off and open the external tube 400 nearest the mouth or nearest the female quick disconnect coupler 420 disposed at the other end of the external tube 400. Alternatively, a stop-cock 410 which may be turned 90 degrees to a locked position from an open position may be used in place of the clamp nearest the mouth with or without the addition of a gendered connector 415, 416 which may be attached to the external barb of flange 330. The clamp 412 or the stop-cock 410 may be used in order to shut off the flow of air that remains in the external tube 400 from going into the mask body interior 210 when not drinking through the secure liquid consumption apparatus 300. On the other end of the stop-cock furthest from the mask body 200, another gendered connector 415, 416 which may be barbed may be placed in order to attach to the external tube 400. The female connector 415 which may be a slip luer, a locking luer, a non-locking luer, a female quick disconnect coupler 420, etc. that may twist, push, click to lock or not lock and may be capable of attaching to a male connector 416 or male quick disconnect coupler 425 and may be made of any suitable material and suitable size and inner diameter for the tube used to provide an available consistent flow of liquid through the gendered connectors when connected to their opposite gendered connector and coupled to the external tube 400 or additional external tube 510 by any means necessary, for example, pushing, clicking together, twisting, screwing, etc. In order to disconnect a similar means will be necessary to disengage the gendered connectors. In the instance of disconnecting the two quick disconnect couplers, a lock release on female quick disconnect coupler 430 is pushed in on said female quick disconnect fitting 420 to disengage the male quick disconnect fitting 425.

The disposable straw unit 500 may contain an additional external tube 510 of same or different internal diameter as the external tube 400. On one end of the disposable straw unit 500, said additional external tube 510 is connected to a male coupler 416 which may be a slip luer, a locking luer, a non-locking luer, a male quick disconnect coupler 425, etc. The other end of the shaft of the additional external tube 520 may be disposed directly into the liquid medium at its liquid engaging open end of additional external tube 530, or may be used with the addition of an attachment unit 413 or attachment modifier 720 made of any suitable material and in any suitable shape such that it may be secured to a bottle or can or other vessel or straw, or vessels already containing straw mechanisms, it may be threaded on the interior or exterior, it may comprise a shape capable of puncturing a side of a vessel or it is capable to secure access to the liquid medium in a vessel.

In other embodiments the tube of the streamlined secure liquid consumption tubular extension device 302 or the disposable straw unit's 500 additional external tube 510 that connects to the male quick disconnect fitting 425 may be cut on one end of the streamlined secure liquid consumption tubular extension device 302 or the shaft of the tubing 520, 530, respectively, straight across forming a 90 degree perpendicular to the side of the shaft of additional external tube 520 or at any angle from about 20-60 degrees and whereby this end is open or at an angle forms the liquid engaging open end of additional external tube 530 or liquid engaging open end of external tube 450 which may be rigid of a secure liquid consumption tubular extension device 302 and may be placed in a liquid contained in any vessel in order to drink that liquid through the embodiment or may be used to puncture through a side of a vessel.

The external tube 400, the additional external tube 510, and the streamlined one piece all inclusive secure liquid consumption tubular extension device 302 should be flexible in nature but may be made of any suitable material including, for example, plastic (e.g., low density polyethylene, polypropylene, polyvinylidene fluoride or polyvinylidene difluoride (PVDF), polyvinyl chloride (PVC), and non-PVCs, anti-microbial coated plastics and thermoplastics). Regardless of the material selected, it should desirably be fabricated into sufficiently sturdy but flexible to function without breaking during normal use.

Figure 5:
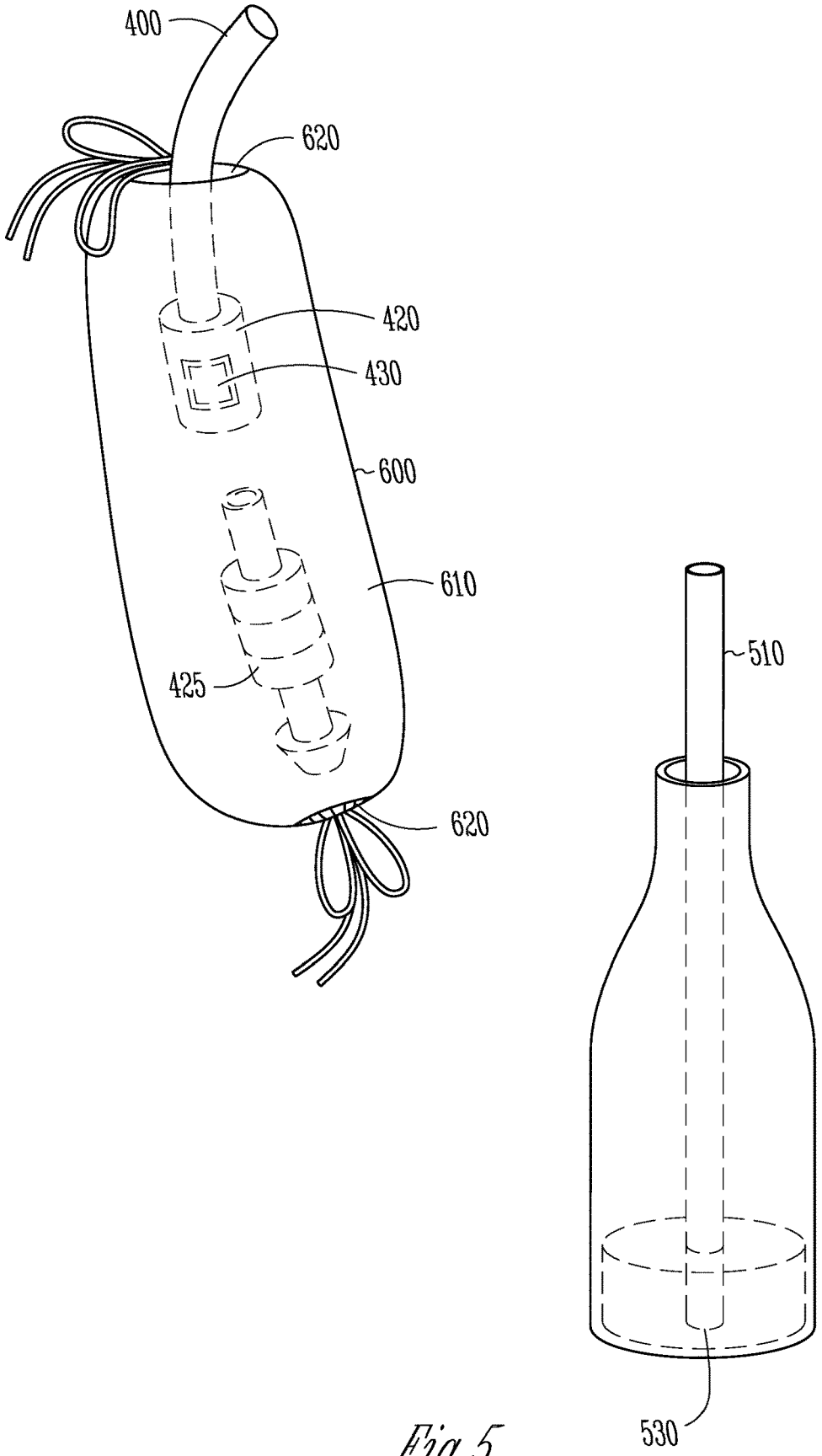
FIG. 5 is a view of the coupling members housed in a sanitary pouch when not used, a used additional external tube has been disconnected and left in a juice bottle

FIG. 5 During disconnection of the gendered couplers, connectors, or tube, the sanitary pouch 600 having an inside and an outside, a top side and a bottom side and one or a plurality of drawstring ends of pouch 620 can be deployed to enclose parts of the secure liquid consumption apparatus 300 and protect it from airborne contaminants. The gendered couplers 415, 416, 420, 425, if present, may be placed in the body of the pouch 610 for storage or cleaning by securing the drawstring ends of the pouch 620. Alternatively, the sanitary pouch 600 may surround and store open end of any tube when not in use. The sanitary pouch 600 may be made of any suitable material, for example, non-wovens, wovens, anti-microbial materials, etc. When the secure liquid consumption tubular device 301 and the male coupler are not in use and stored in the sanitary pouch 600, an attachment clip 700 may be used to secure said device to the lapel or clothing of the wearer for example, shirt, sweater, jacket, etc.

Figure 6A:
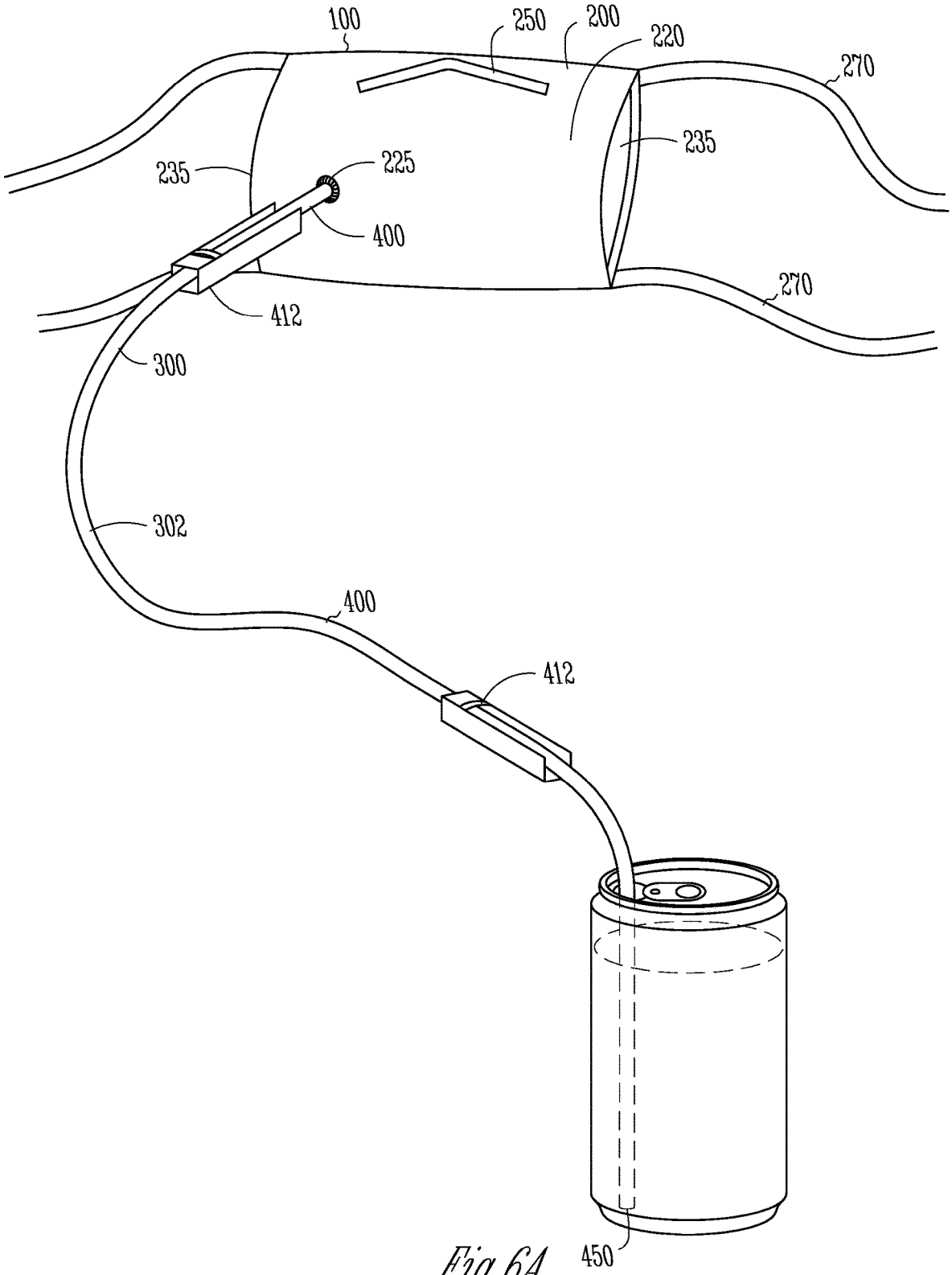
FIG. 6A is a view of a homemade or commercial mask body highlighting the streamlined secure liquid consumption tubular extension device and clamps of the secure liquid consumption face covering used to drink from a can of soda.

FIG. 6A In another embodiment a secure liquid consumption tubular extension device 302 comprises a continuous streamlined unit version of the secure liquid consumption tubular device 301. A secure liquid consumption tubular extension device 302 may be created whereby the flange 305, its mounting base 320, the internal barb of flange 310 and external barb of flange 330 and the external tube 400 are one continual piece and able to be placed directly into a liquid via the liquid engaging open end of external tube 450 on one end whereby the functionality of each of the parts is integrally connected into one unit that is not in need of a quick disconnect coupling device. On the other end mouth piece 315 may have disposed over it a special mouth piece attachment 316. On the shaft of the external tube 401 may be found one or a plurality of clamps 412 of any suitable sort, an attachment clip 700 and a sanitary pouch 600. Many adaptations can occur with a secure liquid consumption tubular extension device 302 whereby a punch type end can be added to puncture through a side of a vessel, a straw can be added, or any other suitable device may be added, or not. When secure liquid consumption tubular extension device 302 is disposed in the mask body 200, said mask body 200 in turn may be modified as needed, for example, to include an exhalation valve 750, to accept goggles 760, a communications device 740, ear canal coverings 780, etc. as modern technology advances.

Figure 6B:
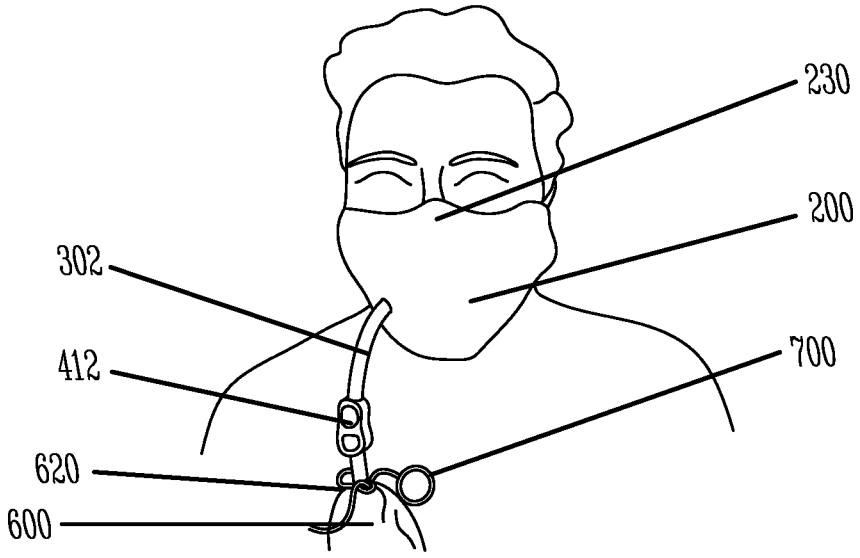
FIG. 6B is a view of an individual wearing a homemade mask body with removable filter where the sanitary pouch is housing and protection from airborne contaminants the streamlined form of a secure liquid consumption tubular extension device which is attached to the sweater of the individual. The clamp is in the locked position.

FIG. 6B In this real life photo, the mask body 200 and removable filter 230 are worn as the clamp 412 is in the locked position and the sanitary pouch 600 covers fully the streamlined secure liquid consumption tubular extension device 302 when not in use. Attachment clip 700 is affixed to the side of the individual's lapel.

Figure 6C:
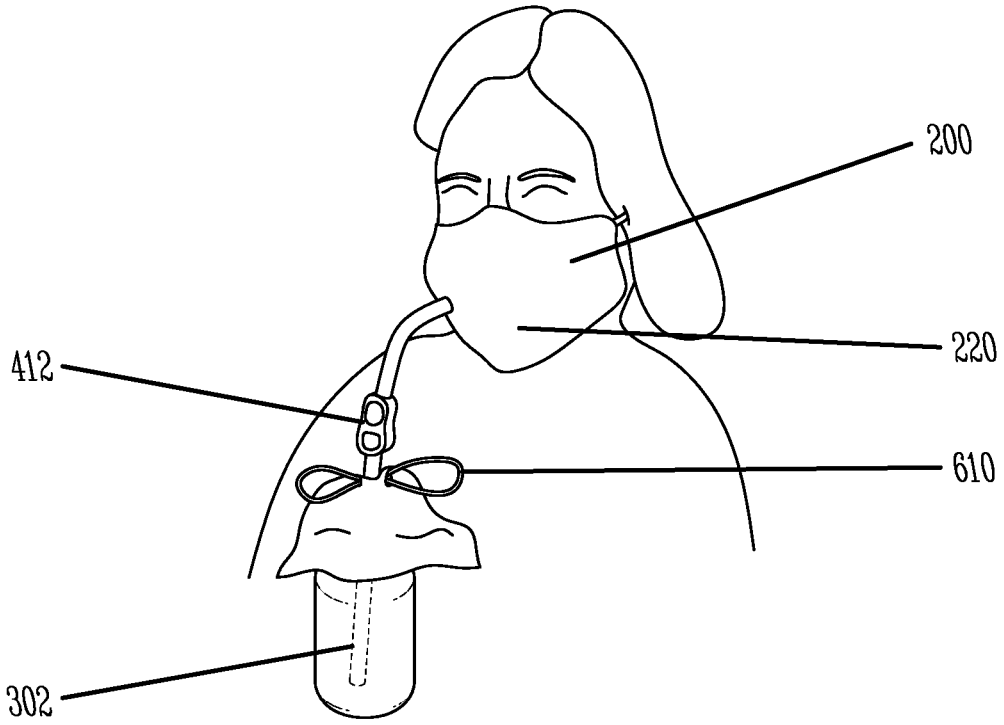
FIG. 6C is a view of an individual drinking from a bottle through a secure liquid consumption face covering comprising a streamlined form of a secure liquid consumption tubular extension device where the clamp is in the open position and the sanitary pouch is scrunched up and covering the opening to the bottle in order to protect its contents and said secure liquid consumption tubular extension device from any possible airborne contaminants.

FIG. 6C In this real life photo, the individual has scrunched up the sanitary pouch 600 exposing the open end of the streamlined secure liquid consumption tubular extension device 302 to be inserted directly into the bottle of water. Note that the sanitary pouch remains fitted around the top of the bottle in order that said open bottle is not exposed to airborne contaminants. After insertion of said device 302 directly into the water, the clamp 412 is opened and the individual is able to drink securely without removing the mask body 200.

Figure 7:
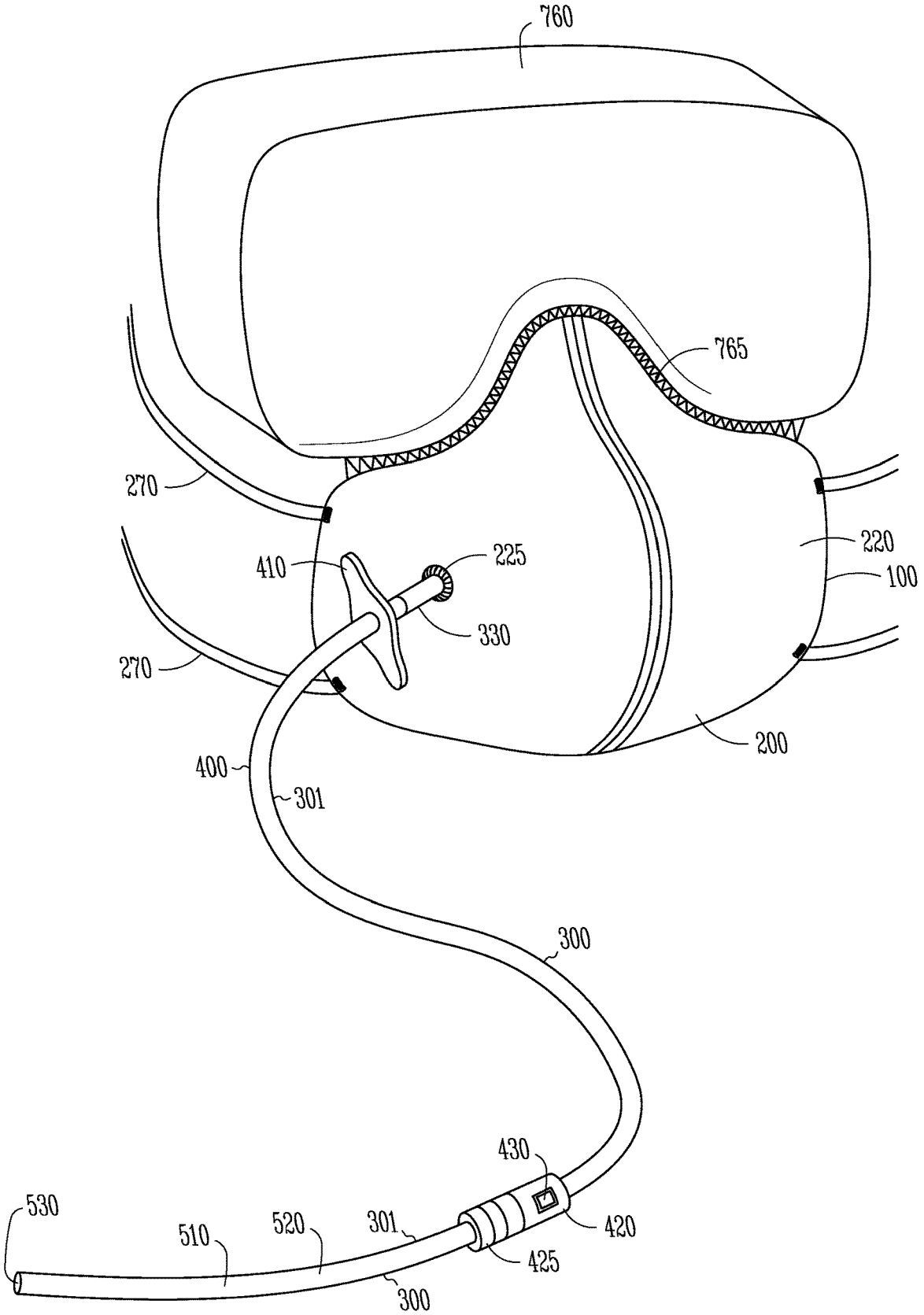
FIG. 7 is a frontal view of a secure liquid consumption face covering and goggles with optional add ons of communication devices, ear buds, etc.

FIG. 7 As technology advances and needs increase and change, the secure liquid consumption face covering can accept a communications device 740 disposed on either the mask body 200 or a harness 270 and on or as an integral part of a goggles 760 such as but not limited to current technology such as built-in or modified communication technology in them or special ear devices or other devices for such but not limited to ear canal coverings 780 by ear canal clips 785, for example, hearing aids, ear buds, earphones, Bluetooth device, or other communications devices 740 that send and receive, sensors of any type, chips, microchips, GPS, cellphone, radio, ham radio, television, internet applications, AI technology, wi-fi, virtual reality programs and capabilities, and other technologies not yet developed or not yet fully developed that would be suitable to include in or on said members 740, 760, 780, 785.

An interior nose unit may contain such an attachment modifier 720 and the mask body 200 be of any such configuration so as to provide a goggle attachment landing space 765 for goggles 760 that the wearer optionally may wear together with the mask. Goggles 760 may be of any shape and form and made of any suitable material. Goggles 760 may be used for welding or other trades, chemical and splash proof, tinted, with UV ray protection, able to detect ultra-violet light, night goggles, prescription goggles, have a dark out option, etc.

Furthermore, ear canal coverings 780 may be in the form of ear buds, earphones, earmuffs, hearing aids, etc or in the form of a material bandana/balaklava, neck gaiter, mask, respirator, etc. that can cover the ears and in turn the ear canal or may be an integral part of goggles 760 such that the portion covering or resting over the ear canal is a device disposed on or embedded into any such material of which goggles are made, or the materials of the face covering itself in the form of the mask body 200 or harness 270.

In another embodiment, an attachment modifier 720 may be placed on the end of the disposable straw unit 500 or to the liquid engaging open end of additional external tube 530 in order for it to be disposed into liquid by attaching to a vessel opening or attaching to an existing simple straw. Alternatively, attachment modifier 720 may be of such nature as a connector with gasket that seals by pushing or screwing to the top of a liquid vessel, water bottle, canteen, plastic cup, juice pack, etc. that may be inverted to drink from by motion of the wearer's mouth. Furthermore, a sanitary pouch 600 made of any suitable material that reflects, deflects, kills micro-organisms such as anti-bacterial or anti-viral material which may have on one end or on a plurality of drawstring ends of pouch 620 that may be secured up and around a shaft of the additional external tube 520 or a replacement disposable straw unit 500.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

What is claimed is:

1. A face covering for drinking a liquid from a container, the face covering comprising:

a mask body sized to fit over at least a nose and mouth of a wearer, the mask body defining a through hole;

a nose adjustor unit configured to create an interior space for the nose and mouth when worn;

a filter configured to filter air from an outer space to the interior space during use, the filter configured to filter from about 30% to about 95% of airborne particulates having a size of about 0.3 microns from the air;

a harness configured to secure the mask body to a head of the wearer;

a liquid consumption apparatus sized to pass through the hole defined by the mask body, the secure liquid consumption apparatus comprising:

a mounting base comprising a flange and a tube extending from a first end to a second end, the tube defining a hollow middle core that extends through the flange, the first end defining a first barbed flange located in the outer space and the second end defining a second barbed flange located in the interior space of the mask body when in use;

a secure liquid consumption device comprising:

a tube that is flexible, a first connector; and a disposable straw unit comprising:

a second connector connectable to the first connector; and an additional tube that is flexible and configured to be disposed into the liquid for drinking purposes;

a sanitary pouch configured to be connected to the additional tube of the disposable straw unit and the container, a portion of the disposable straw unit passing through the sanitary pouch, the sanitary pouch constructed of an antimicrobial material that kills germs on contact;

an attachment clip directly attached to the liquid consumption apparatus; and a lock in fluid communication with the disposable straw unit.

2. The face covering of claim 1, wherein the mask body defines a pouch sized to receive the filter.

3. The face covering of claim 1, further comprising an exhalation valve in fluid communication with the interior space of the mask body.

4. The face covering of claim 1, further comprising a see-through layer over a mouth area.

5. The face covering of claim 2, wherein the filter comprises a removable filter that transverses an area of the pouch unhindered by obstacles fitting snugly disposed next to side seams of the mask body.

6. The face covering of claim 1, wherein the disposable straw unit comprises an open end capable of attaching to a straw.

7. The face covering of claim 1, wherein one of the first or second connectors is a female quick disconnect coupler.

8. The face covering of claim 1, wherein one of the first or second connectors is a male quick disconnect coupler.

9. The face covering of claim 1, further comprising a communication interface that can send and receive data.

10. The face covering of claim 1, further comprise goggles configured to attach to the mask body.

* * * * *